US006852959B1

(12) United States Patent
Han et al.

(10) Patent No.: US 6,852,959 B1
(45) Date of Patent: Feb. 8, 2005

(54) DRIVING CIRCUIT OF DC MICROWAVE OVEN AND METHOD OF CONTROLLING THE SAME

(75) Inventors: Yong-woon Han, Kunpo (KR); Seong-deog Jang, Suwon (KR); Kwang-seok Kang, Suwon (KR); Han-jun Sung, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 349 days.

(21) Appl. No.: 09/890,440

(22) PCT Filed: Nov. 22, 2000

(86) PCT No.: PCT/KR00/01346

§ 371 (c)(1),
(2), (4) Date: Aug. 1, 2001

(87) PCT Pub. No.: WO01/49079

PCT Pub. Date: Jul. 5, 2001

(30) Foreign Application Priority Data

Dec. 9, 1999 (KR) ..... 1999-56264
Dec. 9, 1999 (KR) ..... 1999-56267
Feb. 28, 2000 (KR) ..... 2000-9899

(51) Int. Cl.[7] ..... H05B 6/68
(52) U.S. Cl. ..... 219/716; 219/715; 219/722
(58) Field of Search ..... 219/715, 716, 219/717, 722, 723, 724

(56) References Cited

U.S. PATENT DOCUMENTS 4,904,837 A 2/1990 Low et al.
5,171,949 A 12/1992 Fujishima et al.
5,181,160 A 1/1993 Okamoto et al.
5,237,140 A * 8/1993 Akazawa et al. ..... 219/717
5,276,300 A 1/1994 Low et al.
5,451,750 A * 9/1995 An ..... 219/716

FOREIGN PATENT DOCUMENTS

| | | | |
|---|---|---|---|
| EP | 0-289-032 | 11/1988 | |
| EP | 0-389-047 | 9/1990 | |
| EP | 0-289-032 | 7/1992 | |
| JP | 1-292790 | * 11/1989 | ..... 219/716 |
| JP | 02-306573 | 12/1990 | |
| JP | 03-283289 | 12/1991 | |
| JP | 03-295189 | 12/1991 | |

(List continued on next page.)

OTHER PUBLICATIONS

Office Action issued from Japanese Patent Office, dated May 18, 2004 (no translation attached); Search Report issued from European Patent Office, dated Jul. 7, 2004.

*Primary Examiner*—Philip H. Leung
(74) *Attorney, Agent, or Firm*—Robert E. Bushnell, Esq.

(57) ABSTRACT

Disclosed is a circuit and a method for driving a DC microwave oven. The circuit for driving a DC microwave oven according to the present invention includes: an inverting means to convert DC into AC by a driving pulse; a high voltage transformer to transform the AC from the inverting means, and supply the transformed AC to a magnetron; a pulse driving means to generate the driving pulse; and an over-current detecting means to detect an electric current which is supplied to the inverting means from a DC power source, and output an over-current detect signal if the detected current is determined as an over-current, so as to avoid the generation of the driving pulse by the pulse driving means. According to the present invention, the driving of the magnetron could be stopped when a malfunction of an interlock switch caused by an error or the over-current from the DC power source is detected, and circuit elements can be advantageously prevented from being damaged by the over-current.

13 Claims, 3 Drawing Sheets

FOREIGN PATENT DOCUMENTS

| | | |
|---|---|---|
| JP | 04-087183 | 3/1992 |
| JP | 04-087184 | 3/1992 |
| JP | 04-087185 | 3/1992 |
| JP | 05-094869 | 4/1993 |
| JP | 06-076935 | 3/1994 |
| JP | 2651927 | 5/1997 |
| JP | 09-120887 | 5/1997 |
| JP | 2801367 | 7/1998 |
| KR | 1988-20955 | 11/1988 |
| KR | 1998-063572 | 11/1998 |

* cited by examiner

DRIVING CIRCUIT OF DC MICROWAVE OVEN AND METHOD OF CONTROLLING THE SAME

BACKGROUND OF THE INVENTION

1. Field of the Invention

The present invention relates to a driving circuit of a DC microwave oven and a method of controlling the same, and more particularly to a driving circuit of a DC microwave oven and a method of controlling the same for driving a magnetron through a conversion of a DC voltage into an AC voltage.

2. Description of the Prior Art

A general AC microwave oven is adapted to drive a magnetron thereof for generating a microwave through application of commercial AC voltages of 110–230V.

In the meantime, a DC microwave oven has been developed which may be used in regions outside a town, or in transportation of various kinds such as vehicles, ships, airplanes, and the like, to which the commercial AC voltages are hardly supplied.

The DC microwave oven employing a general DC battery of 12V or 24V requires large currents of 30A–100A in order to drive the magnetron thereof. Accordingly, switches, that is, a primary interlock switch operated in association with the opening and closing of the door of the microwave ovens and a secondary interlock switch operated in response to the manipulations of a cooking on/off button, which directly controls the voltage supply to the DC microwave oven, are required to fully accept the large currents from the DC power supply of the DC battery.

However, there exists a problem in that the switches for the large current are hardly manufactured and the required manufacturing cost is high.

Further, the DC microwave oven must satisfy interlock regulations required by standard institutes for microwave ovens. That is, the DC microwave oven should be in a structure such that it does not drive the magnetron thereof in a short-circuit state of the primary interlock switch and the secondary interlock switch.

In addition to the above, the microwave oven is required to have a structure for protecting circuit components through the suppression of excessive current inflow from a DC power source.

SUMMARY OF THE INVENTION

The present invention is devised to solve the above problem and meet the above requirements, and an object of the present invention is to provide a driving circuit of a DC microwave ovens and a method of controlling the same, capable of protecting circuit components against excessive currents inflowing from a DC power supply.

Another object of the present invention is to provide a driving circuit of a DC microwave oven, and a method of controlling the same, capable of switching on and off a DC power supply through switches of a small capacity, while satisfying the interlock regulations of microwave ovens.

In order to achieve the above objects, according to an embodiment of the present invention, in a driving circuit of a DC microwave oven having an inverting unit for converting a DC voltage of a DC power supply into an AC voltage by driving pulses, a high voltage transformer for transforming the AC voltage applied by the driving of the inverter unit and supplying the transformed AC voltage to a magnetron, and a pulse driving unit for generating the driving pulses, an excessive current detecting unit is provided for detecting a current supplied from the DC power supply to the inverting unit, and outputting an excessive current detecting signal to the pulse driving unit to cut off the generation of the driving pulses of the pulse driving unit if the detected current corresponds to an excessive current.

Preferably, the excessive current detecting unit includes an excessive current detecting part for detecting a current supplied to the inverting unit; and a comparison part for comparing a detecting signal outputted from the excessive current detecting part with a predetermined reference signal, and outputting a comparison result signal, wherein the pulse driving unit stops the generation of the driving pulses if the comparison result signal of the comparator corresponds to the excessive current detecting signal.

It is preferable that the excessive current detecting part include plural bipolar transistors driven in the same periods as the inverting unit with an input of the driving pulses.

Further, an excessive current maintaining unit is further included for continuously maintaining the excessive current detecting signal if the excessive current detecting signal occurs from the excessive current detecting part.

The excessive current maintaining unit includes a feedback transistor turned on with an input of a feedback control signal outputted from the pulse driving unit; and a diode connected between the comparator and the feedback transistor to continuously output to the comparator the feedback signal higher than a reference signal in correspondence with the turn-on of the feedback transistor, the pulse driving unit outputting the feedback control signal in response to the excessive current detecting signal of the comparator.

Further, in order to achieve another object, according to another embodiment of the present invention, in a driving circuit of a DC microwave oven having an inverting unit for converting a DC voltage of a DC power supply into an AC voltage by driving pulses, a high voltage transformer for transforming the AC voltage applied by the driving of the inverting unit and supplying the transformed AC voltage to a magnetron, and a pulse driving unit for generating the driving pulses, a switching unit is provided to be mounted to turn on and off the voltage supply to the pulse driving unit according to the opening and closing operations of a cooking chamber door.

Preferably, the switching unit includes a door sensing switch mounted to directly or indirectly turn on and off a voltage supply path to a voltage input terminal of the pulse driving unit according to the opening and closing states of the cooking chamber door, and a primary interlock switch connected in the voltage supply path to the voltage input terminal of the pulse driving unit to be turned on and off according to the opening and closing operations of the cooking chamber door.

It is preferable that a switch monitor switch be further provided for cutting off the supply of the DC voltage to the high voltage transformer when the cooking chamber door is in the open state.

The switch monitor unit includes plural monitor switches mounted in a position capable of short-circuiting the primary coil of the high voltage transformer, and switched on and off according to the opening and closing operations of the cooking chamber door; and a fuse mounted in a voltage supply path through the plural monitor switches and the DC power supply.

In order to achieve a further object, according to a further embodiment of the present invention, in a driving circuit of a DC microwave oven having an inverting unit for converting a DC voltage of a DC power supply into an AC voltage by driving pulses, a high voltage transformer for transforming the AC voltage applied by the driving of the inverting unit and supplying the transformed AC voltage to a magnetron, and a pulse driving unit for generating the driving pulses, a switch monitor unit is provided for cutting off the supply of a voltage to the high voltage transformer from the DC power supply when a cooking chamber door is in an open state.

Further, in order to achieve the above object, a driving method of a DC microwave oven is provided according to the present invention, the DC microwave oven having an inverting unit for converting a DC voltage of a DC power supply into an AC voltage by driving pulses, a high voltage transformer for transforming the AC voltage applied by the driving of the inverting unit and supplying the transformed AC voltage to a magnetron, a pulse driving unit for generating the driving pulses, and a switching unit for switching on and off the voltage supply to the pulse driving unit from the DC power voltage, and the method comprises steps of a) driving the pulse driving unit by controlling the switching unit if a cooking chamber door is closed and a cooking start selection signal is inputted; b) detecting whether an excessive current is supplied to the high voltage transformer through the inverting unit driven by the pulse driving unit; and c) cutting off the voltage supply to the magnetron by stopping the driving of the pulse driving unit if the excessive current is detected.

BRIEF DESCRIPTION OF THE DRAWINGS

The above objects and the other advantages of the present invention will become more apparent by describing in detail preferred embodiments thereof with reference to the attached drawings, in which.

DESCRIPTION OF THE PREFERRED EMBODIMENT

Figure 1:
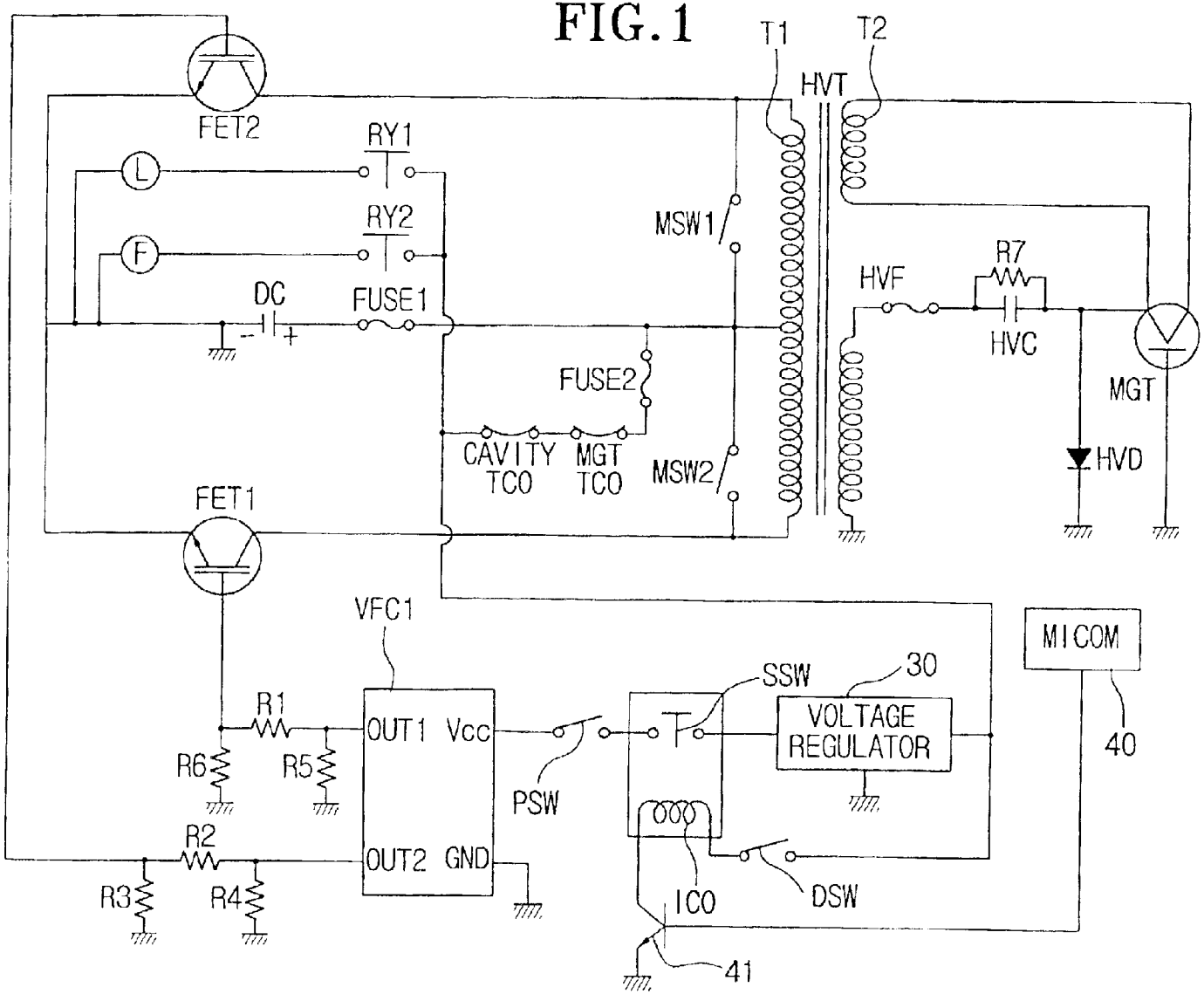
FIG. 1 is a view showing a driving circuit of a DC microwave oven according to a first embodiment of the present invention.

FIG. 1 is a view showing a driving circuit of a DC microwave oven according to a first embodiment of the present invention.

Referring to FIG. 1, the driving circuit of a DC microwave oven is equipped with a DC power supply DC, a door sensing switch DSW, a voltage regulator 30, a primary interlock switch PSW, a secondary interlock switch SSW, and a microcomputer 40.

Further, the driving circuit of a DC microwave oven includes a pulse driving unit VFC1, a push-pull circuit having first and second field effect transistors FET1 and FET2, a high voltage transformer HVT, a magnetron MGT, a door lamp L, a fan motor F, first and second relay switches RY1 and RY2, and first and second monitor switches MSW1 and MSW2.

The push-pull circuit is applied to an inverter unit to supply voltages from the power to supply DC to the primary coil T1 of the high voltage transformer HVT through the driving of the first and second field effect transistors FET1 and FET2 based on a push-pull mode. That is, the first and second field effect transistors FET1 and FET2 are connected to the power supply DC around a tap formed at the center portion of the primary coil T1 of the high voltage transformer HVT to form alternate current passageways.

The pulse driving unit VFC1 of a pulse driving means generates first and second driving pulses, through first and second pulse output terminals OUT1 and OUT2, respectively, which alternately inverts the pulse periods.

The pulse driving unit VFC1 is supplied with a predetermined DC voltage, for example, 15V, through a voltage terminal Vcc connected through the DC power supply DC. Accordingly, the first and second field effect transistors FET1 and FET2 receive the first and second driving pulses generated from the output terminals OUT1 and OUT2 through their respective base terminals, respectively, to be alternately turned on and off.

An AC voltage is applied to the primary coil T1 of the high voltage transformer HVT according to the alternate driving of the first and second field effect transistors FET1 and FET2. Accordingly, a high AC voltage in proportion to a winging ratio is induced in the secondary coil T2 of the high voltage transformer HVT, and an AC voltage, increased by a high voltage capacitor HVC and a high voltage diode HVD which are connected to the secondary coil T2, is applied to the magnetron MGT. Therefore, the magnetron MGT generates a microwave based on the supplied power.

In the meantime, the driving circuit is equipped with a switching unit mounted to switch on and off the power supply to the pulse driving unit VFC1 according to the openings and closings of a cook chamber door (not shown).

The switching unit has the door sensing switch DSW and the primary interlock switch PSW. Preferably, the switching unit includes the secondary interlock switch SSW.

The door sensing switch DSW is mounted to directly or indirectly switch on and off the voltage supply passageways to a voltage input terminal of the pulse driving unit based on the interference of the cooking chamber according to the opening and closing states of the cooking chamber door. The door sensing switch DSW is mounted in order that general micro switches intervene in the opening and closing of the cooking chamber door.

An exciting coil ICO is connected to a ground terminal through a switching transistor 41 under the switching control of a microcomputer 40.

A voltage regulator 30 is connected to the DC power supply DC to supply a voltage required for the voltage input terminal Vcc of the pulse driving unit VFC. That is, an input terminal of the voltage regulator 30 is connected to the DC power supply DC, and an output of the same is connected to the voltage terminal Vcc of the pulse driving unit VFC1 through the primary and secondary interlock switches PSW and SSW.

The voltage regulator 30 regulates voltages from a DC voltage of 12V of the DC power supply DC to a DC voltage of 15V necessary for the operation of the pulse driving unit VFC1, and then supplies the regulated voltage to the voltage input terminal of the pulse driving unit VFC1 through the primary interlock switch PSW and the secondary interlock switch SSW. If a voltage required in the pulse driving unit VFC and an output voltage of the DC power supply DC are the same, the voltage regulator 30 may be omitted.

The primary interlock switch PSW is connected to the voltage supply passageway to the voltage input terminal of the pulse driving unit VFC1. That is, the primary interlock switch PSW is mounted to be switched on in association with the cooking chamber door if the cooking chamber door of the microwave oven is closed.

The secondary interlock switch SSW is connected in series with the primary interlock switch PSW on the voltage supply passageway to the voltage input terminal of the pulse driving unit VFC1, and is mounted to control the switching-on and the switching-off according to the states of the door sensing switch DSW. That is, if switching transistor 41 is turned on by the control of the microcomputer 40 which controls the execution of the cooking functions in a state wherein the door sensing switch DSW is switched on, the secondary interlock switch SSW is switched on by the conduction of current in the exciting coil ICO.

The first and second monitor switches MSW1 and MSW2 are installed as a switch monitor unit for cutting off the voltage supply to the high voltage transformer HVT of the DC power supply when the cooking chamber door is in an open state.

The first and second monitor switches MSW1 and MSW2 are mounted in parallel with the primary coil T1 of the high voltage transformer HVT.

That is, the first and second monitor switches MSW1 and MSW2 are installed on the positions suitable for turning off the primary coil T1 of the high voltage transformer HVT, so that the switches MSW1 and MSW2 are switched on and off according to the opening and closing operations of the cooking chamber door.

The first and second monitor switches MSW1 and MSW2 are mounted so as to be associated with the cooking chamber door, and so as to be switched on when the cooking chamber door is opened and switched off when the cooking chamber door is closed. Accordingly, when the door is opened, a voltage supply to the high voltage transformer HVT is suppressed by the first and second monitor switches MSW1 and MSW2, even though if the switches DSW and PSW are turned on due to malfunctions of the switching unit.

In the meantime, a fuse FUSE1 for protecting components when a large current flows in the state that the first and second monitor switches MSW1 and MSW2 are turned on is mounted in the voltage supply passageway having the monitor switches MSW1 and MSW2 and the DC power supply DC. That is, first ends of the monitor switches MSW1 and MSW2 are connected to the DC power supply DC through the fuse FUSE1, and second ends thereof are connected between corresponding field effect transistors FET1 and FET2 and the primary coil T1 of the high voltage transformer HVT. Accordingly, the fuse FUSE1 is opened by a large current flowing when a closed circuit is formed as the first and second monitor switches MSW1 and MSW2 are switched on, thereby preventing the driving of the magnetron MGT.

The microcomputer 40 is in charge of overall cods control with respect to diverse cooking functions which are provided. The microcomputer 40 switches on the secondary interlock switch SSW by driving the switching transistor 41 if an input signal for executing a certain cooking function is inputted through an operation panel by a user in the state where the door is closed.

Accordingly, if the primary interlock switch PSW and the secondary interlock switch SSW are respectively switched on, a DC voltage of 15V from the voltage regulator 30 is applied to the voltage terminal Vcc of the pulse driving unit VFC1.

A first relay switch RY1 is switched on when the door sensing switch DSW is switched off according to the open state of the door. Accordingly, a door lamp L is lit with the supply of the DC voltage from the DC power supply DC if the first relay switch RY1 is turned on.

A second relay switch RY2 is switched on in association with an input of a cooking start selection signal from the operation panel by a user in the state where the door sensing switch DSW is turned on. Accordingly, a fan motor F for cooling the magnetron MGT is rotated by the DC power voltage in the state where the second relay switch RY2 is turned on.

The first and second relay switches RY1 and RY2 are preferably controlled by the microcomputer 40.

Hereinafter, the operation of the driving circuit of a microwave oven is described in detail.

First of all, when the cooking chamber door is opened, the door sensing switch DSW and the primary interlock switch PSW are turned off. Therefore, voltage supply to the pulse driving unit VFC1 from the voltage regulator 30 is cut off, and the first and second field effect transistors FET1 and FET2 are turned off, so that the voltage supply to the magnetron MGT is not achieved.

In the meantime, if the cooking chamber door is closed, the door sensing switch DSW and the primary interlock switch PSW are turned on in correspondence with the closed state of the cooking chamber door.

If a cooking start selection button is pressed from the operation panel as a result of manipulation by a user in the state wherein the door is closed, the microcomputer 40 turns the switching transistor 41 on. Therefore, the secondary interlock switch SSW is turned on by an electromagnetic force generated by the conduction of current through the exciting coil ICO.

If the primary interlock switch PSW and the secondary interlock switch SSW are both turned on, the pulse driving unit VFC1 is operated by a voltage supplied from the voltage regulator 30, and generates first and second pulse signals with alternate pulse-generating periods through first and second pulse output terminals OUT1 and OUT2.

In the meantime, the first and second field effect transistors FET1 and FET2 are alternately turned on and off by the first and second pulse signals generated by the pulse driving unit VFC1. According to the alternate turning on and off of the first and second field effect transistors FET1 and FET2, an AC voltage is applied to the primary coil T1 of the high voltage transformer HVT, and a high voltage is induced in the secondary coil T2.

Accordingly, the magnetron MGT is driven by the voltage induced in the secondary coil of the high voltage transformer HVT and increased by the high voltage capacitor HVC and the high voltage diode HVD so as to generate a microwave.

In the meantime, if a short-circuited state is maintained even though the cooking chamber door is opened due to malfunction of the primary interlock switch PSW and the secondary interlock switch SSW, the fuse FUSE1 is opened by the first and second monitor switches MSW1 and MSW2, which are turned on according to the opening of the cooking chamber door. If the fuse FUSE1 is opened, a voltage supply to the high voltage transformer HVT from the DC power supply DC is cut off, so that the driving of the magnetron MGT is stopped.

Next, with reference to FIG. 2, the driving circuit of a DC microwave oven according to the second embodiment will be described.

The components having the same functions as those in the previous drawing will be indicated by the same reference numerals, and will not be described in detail.

Figure 2:
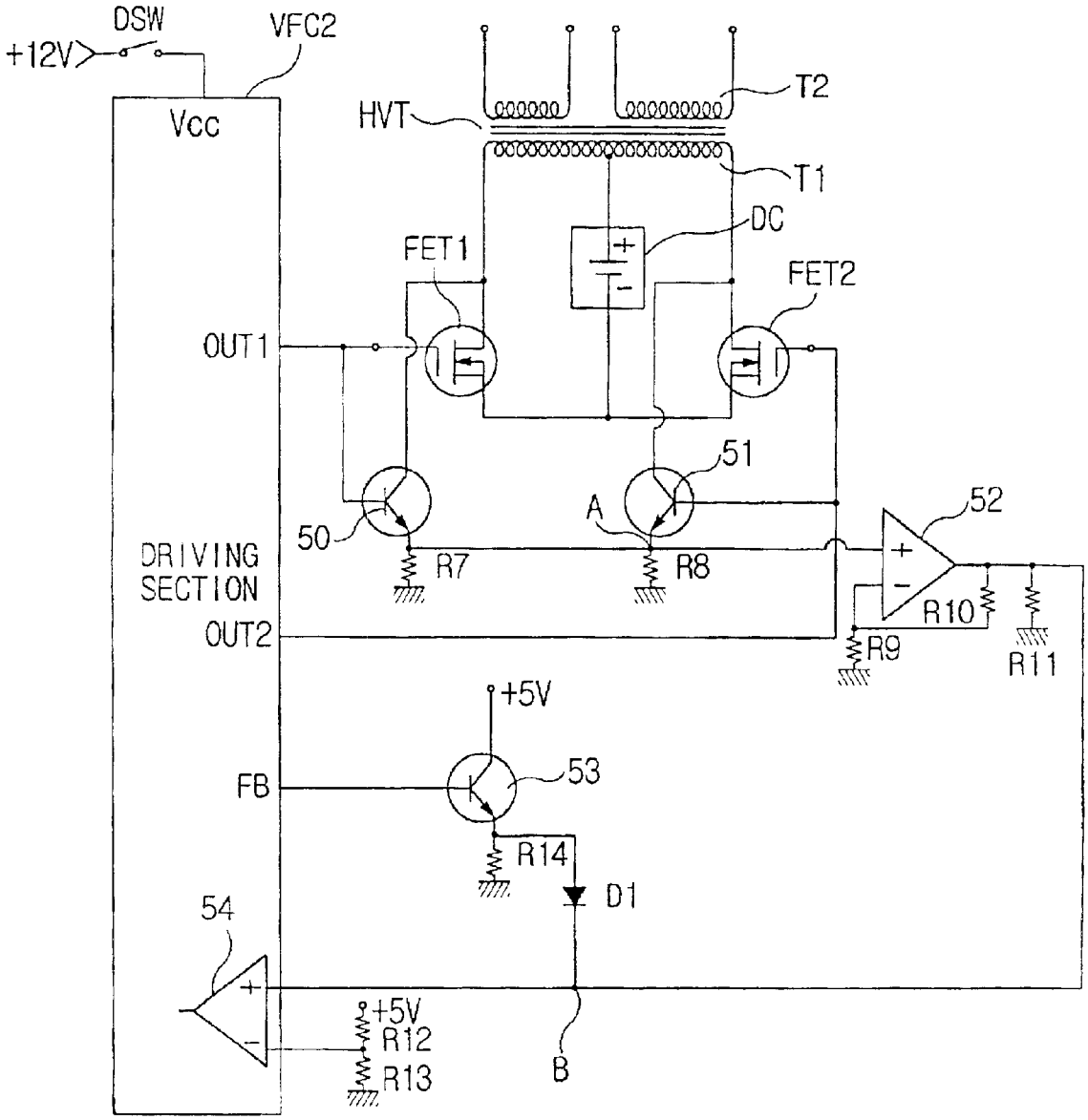
FIG. 2 is a view showing a driving circuit of a DC microwave oven according to a second embodiment of the present invention.

Referring to FIG. 2, the driving circuit of a microwave oven includes first and second transistors 50 and 51, an operational amplifier 52, a third transistor 53, a diode D1, and a pulse driving unit VFC2.

Reference numeral 54 indicates a comparator built into the pulse driving unit VFC2.

An excessive current detecting unit includes an excessive current detecting part and a comparison part.

The excessive current detecting part detects a current supplied through the first and second field effect transistors FET1 and FET2 as an inverting unit.

The base electrodes of the first and second transistors 50 and 51 form the excessive current detecting part and are connected to the first and second pulse output terminals OUT1 and OUT2 respectively, of the pulse driving circuit VFC2. Further, the collector electrodes of the first and second transistors 50 and 51 are connected to the positive terminal of the DC power supply DC through the primary coil T1 of the high voltage transformer HVT, and the emitter electrodes thereof are connected to ground through resistors R7 and R8, respectively.

Accordingly, the first and second transistors 50 and 51 are driven in association with the first and second field effect transistors FET1 and FET2. That is, the first and second transistors 50 and 51 are alternately turned on by the first and second pulse signals alternately generated from the first and second pulse output terminals OUT1 and OUT2 of the pulse driving unit VFC2.

In the meantime, the current flowing through the first and second transistors 50 and 51 corresponds in amount to a current flowing in the primary coil T1 of the high voltage transformer HVT. Accordingly, if there is an amount of current alternately flowing in the primary coil T1 of the high voltage transformer HVT, a voltage level dropped by resistors connected with the first and second transistors 50 and 51 is increases.

A common connection is performed between the emitter of the first transistor 50 and the resistor R7 and between the emitter of the second transistor 51 and the resistor R8, and the common connection is connected to the non-inverting input terminal of the operational amplifier 52.

The inverting terminal of the operational amplifier 52, which is an element of an amplification unit for amplifying a current detecting signal, is grounded through a resistor R9, and the output terminal thereof is also grounded through another resistor R10.

The operational amplifier 52 amplifies a resultant voltage of the voltages outputted from the respective emitter terminals of the first and second transistors 50 and 51 in accordance with an amplification rate determined by the voltage division resistors R9 and R10 for an output.

The non-inverting input terminal of a comparator 54 employed for the comparison part is connected to the output terminal of the operational amplifier 52, and the inverting terminal thereof is connected between voltage-dividing resistors R12 and R13 which generate a reference voltage by dividing a voltage of 5V.

FIG. 2 shows that an operational amplifier 54 in the pulse driving unit VFC2 is used as the comparator 54 when a commercial integrated circuit having a redundant operational amplifier in addition to a pulse generator, is used as the pulse driving unit VFC2. The pulse driving unit VFC2 is adapted to be supplied with a voltage through the door sensing switch DSW from the DC power supply DC, for example, 12V.

In the meantime, if an excessive current detecting signal is generated by the excessive current detecting unit, an excessive current maintaining unit is further included, preferably, to apply the excessive current detecting signal while continuously maintaining the excessive current detecting signal.

The excessive current maintaining unit includes a feedback part.

The feedback part has a third transistor 53 connected to the non-inverting terminal of the comparator 54, a resistor R14, and a diode D1.

The base electrode of the third transistor 53 is connected to a feedback terminal FB of the pulse driving unit VFC2. The emitter electrode of the third transistor 53 is connected to ground through the resistor R14, and is connected to the non-inverting terminal of the comparator 54 through the diode D1.

Here, if the pulse driving unit VFC2 generates a comparison result signal corresponding to a condition wherein a voltage exceeding the reference voltage from the comparator 54 is detected, the outputs of the first and second pulse signals from the first and second pulse output terminals OUT1 and OUT2 are stopped. At the same time, the pulse driving unit VFC2 continuously generates a feedback control signal which turns the third transistor 53 on through the feedback terminal FB.

Therefore, the third transistor 53 maintains a turned-on state by inputting through the base electrode thereof the feedback control signal continuously outputted from the pulse driving unit VFC2, and the feedback signal outputted through the diode D1 is inputted to the comparator 54 as a voltage exceeding the reference voltage induced in the inverting terminal of the comparator 54.

Hereinafter, the operation of the driving circuit of a microwave oven according to the second embodiment of the present invention will be described in detail.

First of all, if the door sensing switch DSW is switched on, the pulse driving unit VFC2 is driven with an input of a DC voltage of 12V through the voltage terminal Vcc. The driven pulse driving unit VFC2 generates the first and second pulse signals having alternate pulse periods relative to each other through the first and second pulse output terminals OUT1 and OUT2, respectively.

At this time, the first and second field effect transistors FET1 and FET2 are alternately turned on by the first and second pulse signals outputted from the pulse driving unit VFC2. Therefore, as described above, an AC voltage is applied to the primary coil T1 of the high voltage transformer HVT, and the magnetron (not shown) connected to the secondary coil T2 of the transformer HVT is driven.

Further, the first and second transistors 50 and 51 are alternately switched on in association with the alternate switching-on operations of the first and second field effect transistors FET1 and FET12.

The operational amplifier 52 receives an input formed in the emitter electrodes of the first and second transistors 50 and 51, respectively, through the non-inverting terminal, amplifies the input, and outputs a resultant voltage and the comparator 54 built into the pulse driving unit VFC2 compares the voltage signal outputted from the operational amplifier 52 with the reference voltage produced by the voltage-dividing resistors R12 and R13, and generates a comparison result signal.

During the operation, if an excessive current is applied to the high voltage transformer HVT, the voltages of the emitter electrodes of the first and second transistors 50 and 51 are increased, so that the comparator 54 outputs a signal of a high level.

If the signal of a high level corresponding to the excessive current detecting signal is inputted from the comparator 54, the pulse driving unit VFC2 stops the outputs of the first and second pulse signals from the first and second pulse output terminals OUT1 and OUT2, and continuously generates a feedback control signal through the feedback terminal FE. Therefore, the third transistor 53 is continuously turned on with an input of the feedback control signal, and the comparator 54 continuously outputs the excessive voltage detecting signal by the feedback voltage applied in correspondence with the excessive current detection through the diode D1.

As a result, the first and second field effect transistors FET1 and FET2 maintain the turn-off states thereof, so that the driving of the magnetron is stopped. Accordingly, related circuit components including the first and second field effect transistors FET1 and FET2 are protected from an excessive current.

Hereinafter, the driving circuit of a DC microwave oven according to the third embodiment of the present invention will be described with reference to FIG. 3.

The components having the same functions as those in the previous drawing will be indicated by the same reference numerals, and will not be described in detail.

Figure 3:
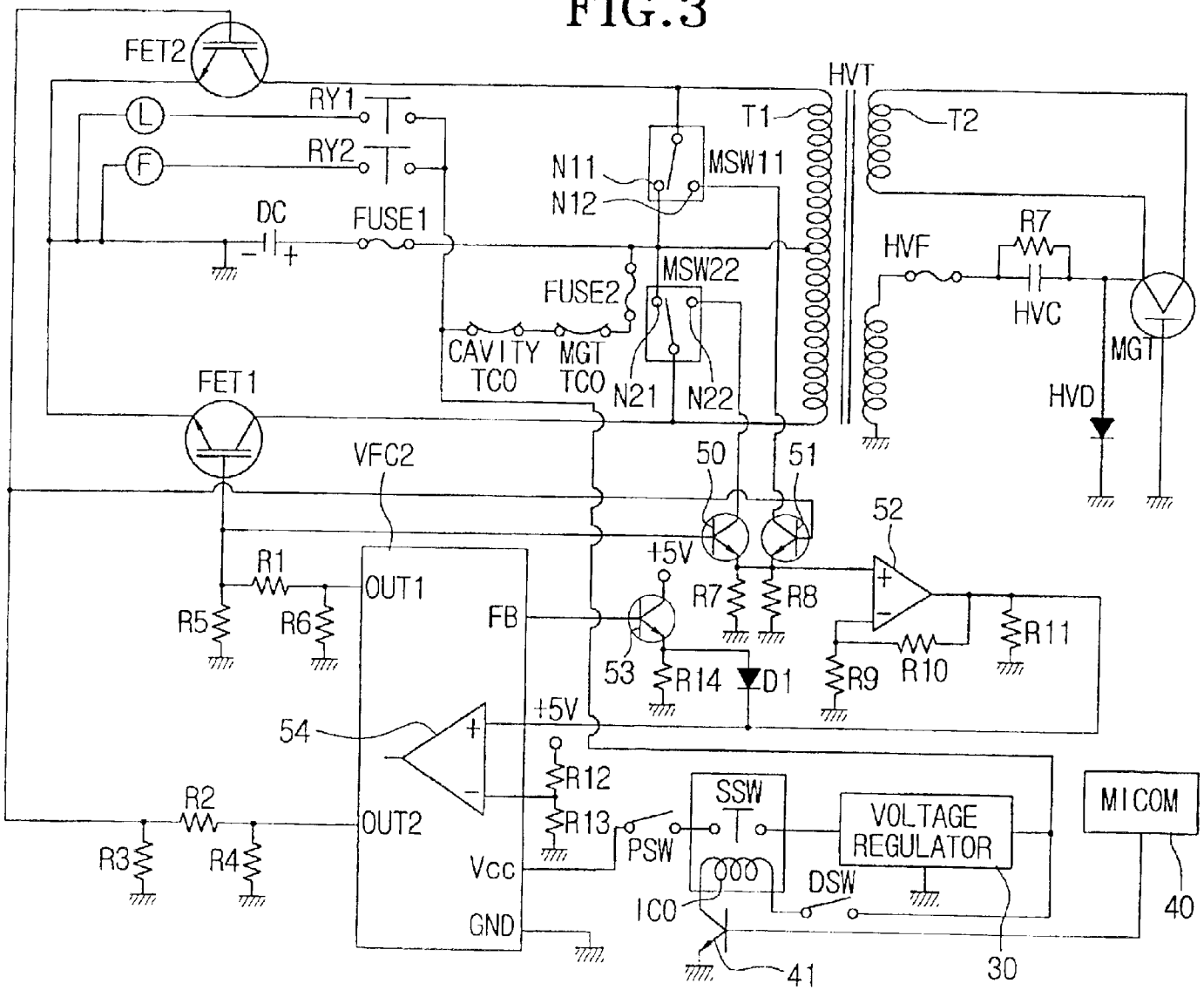
FIG. 3 is a view showing a driving circuit of a DC microwave oven according to a third embodiment of the present invention.

Referring to FIG. 3, the driving circuit has first and second monitor switches MSW11 and MSW22, first and second transistors 50 and 51, an operational amplifier 52, a third transistor 53, a diode D1, a pulse driving unit VFC2, and a comparator 54 built into the pulse driving unit VFC2.

The first switching contacts N11 and N21 of the first and second monitor switches MSW11 and MSW22 as a switch monitor unit are commonly connected to the positive terminal of the DC power supply DC through the fuse FUSE1, and the second switching contacts N12 and N22 are connected to the first and second transistors 50 and 51 which are elements of an excessive current detecting/maintaining unit.

Here, the excessive current detecting/maintaining unit includes the excessive current detecting unit and the excessive current maintaining unit as described above.

The first and second monitor switches MSW11 and MSW22, each having three terminals, selects either of a first loop passing from the DC power supply DC to the fuse FUSE1, or a second loop passing the excessive current detecting/maintaining unit by switching operations. That is, the fixed terminals of the first and second monitor switches MSW11 and MSW22 are connected on a current supply path connecting the first and second field effect transistors FET1 and FET2 of an inverter unit and the high voltage transformer HVT, the first contact N11 selectively switched with the fixed terminal: is connected to the DC power supply through the fuse FUSE1, and the second contact N12 selectively switched with the fixed terminal is connected to a unit for carrying out the detection of an excessive current when the cooking chamber door is closed.

The first and second monitor switches MSW11 and MSW22 are operated with the cooking chamber door, so as to be connected to the first switching contacts N11 and N21 if the cooking chamber door is opened, and to be connected to the second switching contacts N12 and N22 if the cooking chamber door is closed.

In the meantime, if the primary interlock switch PSW and the secondary interlock switch SSW are short-circuited due to a malfunction when the cooking chamber door is opened, the fuse FUSE1 is opened by the first and second monitor switches MSW11 and MSW22, being connected to the first switching contacts N11 and N21.

The base electrodes of the first and second transistors 50 and 51 are connected to the first and second pulse output terminals OUT1 and OUT2 of the pulse driving unit VFC2.

The collector electrodes of the first and second transistors 50 and 51 are connected to the second switching contacts N12 and N22 of the first and second monitor switches MSW11 and MSW22, and the emitter electrodes thereof are connected to ground through the resistors R7 and R8.

Hereinafter, the operation of the driving circuit of a microwave oven according to the third embodiment will be described in detail.

First of all, if the primary interlock switch PSW and the secondary interlock switch SSW are turned on to receive a DC voltage of 15V outputted from the voltage regulator 30 through the voltage terminal Vcc, the pulse driving unit VFC2 generates the first and second pulse signals with alternating pulse generating periods through the first and second pulse output terminals OUT1 and OUT2 thereof. Therefore, as stated above, an AC voltage is applied to the high voltage transformer HVT, thereby driving the magnetron MGT. At this time, the switch terminals of the first and second monitor switches MSW11 and MSW22 are connected to the second switching contacts N12 and N22.

In the meantime, during the driving operation, if an excessive current is generated in a closed circuit formed by the alternate switching-on operations of the first and second field effect transistors FET1 and FET2, a current flowing through the first and second transistors 50 and 51 is increased as stated above. As a result, the comparator 54 outputs a comparison result signal of a high level corresponding to the excessive current detection.

Therefore, the pulse driving unit VFC2 continuously generates a feedback control signal through the feedback terminal FB to maintain the detection state of an excessive voltage, and the first and second field effect transistors FET1 and FET2 are controlled to be switched off, so that the driving of the magnetron is stopped.

In the meantime, if the primary interlock switch PSW and the secondary interlock switch SSW are abnormally short-circuited when the cooking chamber door is opened, a current flowing through the first and second field effect transistors FET1 and FET2, as a result of the switching terminals of the first and second monitor switches MSW11 and MSW22 being switched to the first switching contacts N11 and N21, is bypassed. At this time, the fuse FUSE1 is opened by a large current.

As a result, the driving of the magnetron MGT through the high voltage transformer HVT is stopped, to thereby protect circuit components.

As stated above, the driving circuit of a DC microwave oven according to the present invention is devised to control the driving of the push-pull circuit for converting a DC voltage into an AC voltage by a pulse signal outputted from the pulse driving unit, and has low-current interlock switches in power supply paths connecting the DC power supply and the pulse driving unit, so that the switching-on and switching-off controls of the DC power supply in association with the cooking chamber door are facilitated.

Further, the driving circuit of a DC microwave oven according to the present invention has the advantage of being capable of stopping the driving of the magnetron as malfunctions of the interlock switches occur or as an excessive current is generated from the DC power supply due to the occurrence of abnormal states, and the further advantage of preventing damages damage to circuit components due to the excessive current.

Although the preferred embodiments of the present invention have been described, it will be understood by those skilled in the art that the present invention should not be limited to the described preferred embodiments, but various changes and modifications can be made within the spirit and scope of the present invention as defined by the appended claims.

What is claimed is:

1. A driving circuit of a DC microwave oven having an inverting unit for converting a DC voltage of a DC power supply into an AC voltage by driving pulses, a high voltage transformer for transforming the AC voltage applied by the driving of the inverting unit and supplying the transformed AC voltage to a magnetron, and a pulse driving unit for generating the driving pulses, said driving circuit comprising:

an excessive current detecting unit for detecting a current supplied from the DC power supply to the inverting unit, and for outputting an excessive current detecting signal to the pulse driving unit to cut off the generation of the driving pulses of the pulse driving unit when the detected current corresponds to an excessive current; and an excessive current maintaining unit for continuously maintaining the excessive current detecting signal when the excessive current detecting signal is outputted by the excessive current detecting unit;

wherein the excessive current maintaining unit includes a feedback transistor turned on by an input of a feedback control signal outputted from the pulse driving unit, and a diode connected between the feedback transistor and the comparison part for continuously outputting to the comparison part a feedback signal higher than a reference signal in correspondence with turn-on of the feedback transistor, the pulse driving unit outputting the feedback control signal in response to outputting of the comparison result signal comprising the excessive current detecting signal by the comparison part.

2. The driving circuit as claimed in claim 1, wherein the excessive current detecting unit includes:

an excessive current detecting part for detecting a current supplied to the inverting unit; and a comparison part for comparing a detecting signal outputted from the excessive current detecting part with a predetermined reference signal, and for outputting a comparison result signal, wherein the comparison result signal comprises the excessive current detecting signal when the detected current corresponds to an excessive current, and wherein the pulse driving unit stops the generation of the driving pulses when the comparison result signal of the comparison part comprises the excessive current detecting signal.

3. The driving circuit as claimed in claim 2, further comprising:

an amplification part for amplifying the detecting signal outputted from the excessive current detecting part and applying the amplified detecting signal to the comparison part.

4. The driving circuit as claimed in claim 2, wherein the excessive current detecting part includes plural bipolar transistors driven with the same periods as the inverting unit with an input of the driving pulses.

5. A driving circuit of a DC microwave oven having an inverting unit for converting a DC voltage of a DC power supply into an AC voltage by driving pulses, a high voltage transformer for transforming the AC voltage applied by the driving of the inverting unit and supplying the transformed AC voltage to a magnetron, and a pulse driving unit for generating the driving pulses, said driving circuit comprising:

a switch monitor unit for cutting off supply of a voltage to the high voltage transformer from the DC power supply when a cooking chamber door is in an open state; and an excessive current detecting/maintaining unit for detecting a current provided by the DC power supply through the switch monitor unit, and for outputting an excessive current detecting signal to the pulse driving unit to cut off generation of the driving pulses by the pulse driving unit;

wherein the switch monitor unit includes a plurality of monitor switches connected to a primary coil of the high voltage transformer for selectively short-circuiting the primary coil of the high voltage transformer, and switched according to opening and closing operations of the cooking chamber door, and a fuse mounted in a voltage supply path connecting the plurality of monitor switches and the DC power supply.

6. The driving circuit as claimed in claim 5, wherein first ends of the plurality of monitor switches are connected to the DC power supply through the fuse, and second ends of the plurality of monitor switches are connected between the inverting unit and the primary coil of the high voltage transformer.

7. The driving circuit as claimed in claim 5, wherein the excessive current detecting/maintaining unit includes:

an excessive current detecting part for detecting a current supplied to the inverting unit;

a comparison part for comparing a detecting signal outputted from the excessive current detecting part with a predetermined reference signal, and for outputting a comparison result signal; and a feedback part for outputting to the comparison part a feedback signal exceeding the predetermined reference signal for control of the pulse driving unit.

8. The driving circuit as claimed in claim 7, further comprising:

an amplifying unit for amplifying the detecting signal outputted from the excessive current detecting part and applying the amplified detecting signal to the comparison part.

9. The driving circuit as claimed in claim 5, further comprising a switching unit mounted to turn on and off the voltage supply to the pulse driving unit according to opening and closing operations of a cooking chamber door.

10. A driving circuit of a DC microwave oven having an inverting unit for converting a DC voltage of a DC power supply into an AC voltage by driving pulses, a high voltage transformer for transforming the AC voltage applied by the driving of the inverting unit and supplying the transformed AC voltage to a magnetron, and a pulse driving unit for generating the driving pulses, said driving circuit comprising:

a switch monitor unit for cutting off supply of a voltage to the high voltage transformer from the DC power supply when a cooking chamber door is in an open state; and an excessive current detecting/maintaining unit for detecting a current provided by the DC power supply through the switch monitor unit, and for outputting an excessive current detecting signal to the pulse driving unit to cut off generation of the driving pulses by the pulse driving unit;

wherein the switch monitor unit includes a three-terminal monitor switch for selecting one of a first loop connecting the DC power supply and the fuse, and a second loop connected to the excessive current detecting/maintaining unit by switching operations of the three-terminal monitor switch.

11. The driving circuit as claimed in claim 10, further comprising a switching unit mounted to turn on and off the voltage supply to the pulse driving unit according to opening and closing operations of a cooking chamber door.

12. A driving method of a DC microwave oven having an inverting unit driven by driving pulses for converting a DC voltage of a DC power supply into an AC voltage, a high voltage transformer for transforming the AC voltage applied by the driving of the inverting unit and supplying the transformed AC voltage to a magnetron, a pulse driving unit for generating the driving pulses for driving the inverting unit, and a switching unit for switching on and off voltage supply to the pulse driving unit from the DC power voltage, said method comprising steps of:

a) driving the pulse driving unit by controlling the switching unit when a cooking chamber door is closed and a cooking start selection signal is inputted;

b) detecting whether an excessive current is supplied to the high voltage transformer through the inverting unit driven by the driving pulses generated by the pulse driving unit;

c) cutting off the AC voltage supply to the magnetron by stopping the driving of the pulse driving unit when the excessive current is detected; and d) providing a three-terminal monitor switch having a fixed terminal connected in a voltage supply path connecting the inverting unit and the high voltage transformer, a first contact selectively switched to the fixed terminal so as to be connected to the DC power supply through a fuse, and a second contact selectively switched to the fixed terminal so as to be connected to a unit for carrying out the detection of the excessive current when the cooking chamber door is closed, the fixed terminal being switched to the second contact in step b).

13. The driving method as claimed in claim 12, further comprising the step of:

forming a voltage supply path in parallel with the high voltage transformer when the cooking chamber door is opened in a state wherein the excessive current is not detected, and opening the voltage supply to the inverting unit from the DC power supply when an excessive current flows in the voltage supply path formed in parallel with the high voltage transformer.

* * * * *